US005720607A

United States Patent [19]

Morio et al.

[11] Patent Number: 5,720,607

[45] Date of Patent: Feb. 24, 1998

[54] IGNITOR

[75] Inventors: Shuji Morio; Yasuhiro Oya; Nobumasa Iguchi, all of Kanagawa, Japan

[73] Assignee: Yamatake-Honeywell Co., Ltd., Japan

[21] Appl. No.: 589,744

[22] Filed: Jan. 22, 1996

[30] Foreign Application Priority Data

Jan. 30, 1995 [JP] Japan ..... 7-012444

[51] Int. Cl.[6] ..... F23N 5/24

[52] U.S. Cl. ..... 431/18; 431/28; 431/45; 431/66; 431/73; 431/80

[58] Field of Search ..... 431/18, 45, 66, 431/73, 28, 67, 68, 74, 78, 80

[56] References Cited

U.S. PATENT DOCUMENTS

| | | | |
|---|---|---|---|
| 4,194,875 | 3/1980 | Hewitt | 431/45 |
| 5,515,297 | 5/1996 | Bunting | 431/18 X |
| 5,612,904 | 3/1997 | Bunting | 431/18 |

*Primary Examiner*—Larry Jones

*Attorney, Agent, or Firm*—Blakely Sokoloff Taylor & Zafman

[57] ABSTRACT

An ignitor includes a first transistor, a transformer, an ignition member, and a switching control member. The first transistor is activated in accordance with supply from a DC power supply to perform switching. The transformer has a primary winding through which a switching current flows via the first transistor, a secondary winding for generating high voltage when the switching current flows through the first winding, and a tertiary winding for generating a control output for controlling the switching of the first transistor in accordance with the high voltage generated in the secondary winding. The ignition member ignites a target object using the high voltage generated in the secondary winding of the transformer. The switching control member prolongs the ON time for the switching of the first transistor in accordance with a decrease in at least one of the ambient temperature and the power supply voltage.

5 Claims, 7 Drawing Sheets

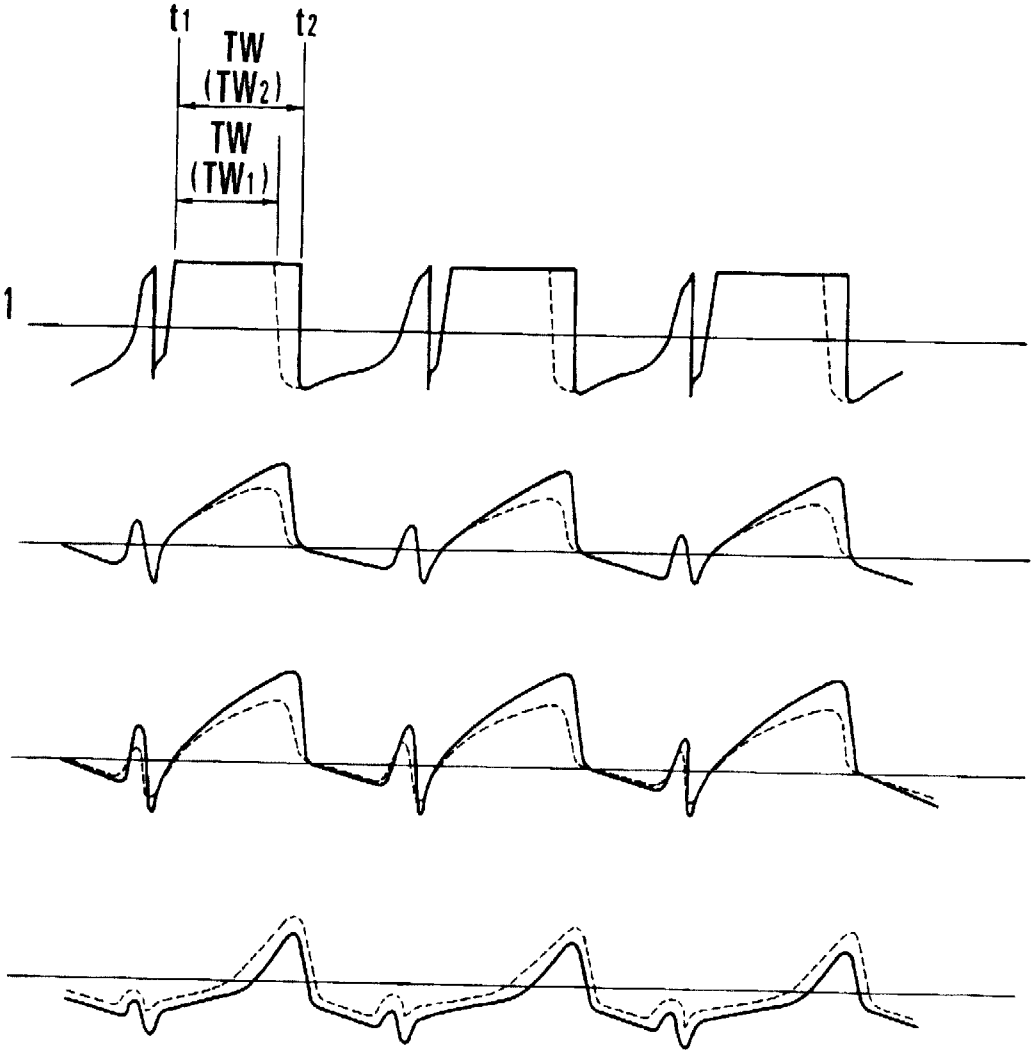
FIG.2A BASE-EMITTER VOLTAGE Q101 $V_{BE}$
FIG.2B BASE CURRENT Q101 $I_B$
FIG.2C COLLECTOR CURRENT Q101 $I_{101}$
FIG.2D COLLECTOR CURRENT Q102 $I_{103}$

P7

P8

P9

P10
t1 t2

P11

P12

P13
TW (TW2)
TW (TW1)

P14

I201

IGNITOR

BACKGROUND OF THE INVENTION

The present invention relates to an ignitor for igniting a target object such as oil and gas.

As a conventional ignitor of this type, there is a solid-state ignitor whose circuit diagram is shown in FIG. 8. Referring to FIG. 8, reference symbol $V_{AC}$ denotes a commercial power supply (AC 100 V); D1, a diode; C1 and C2, capacitors; Q1, a main transistor; R1, a resistor for activating the main transistor Q1; T1, a transformer; L1, a primary winding of the transformer T1; L2, a secondary winding of the transformer T1; and L3, a tertiary winding of the transformer T1.

In this circuit, the commercial power supply $V_{AC}$ is rectified and smoothed by the diode D1 and the capacitor C2, and DC power supply voltage $V_{DC}$ is applied to a circuit connected to the output stage. By this power supply voltage $V_{DC}$, a base current flows via the resistor R1 to activate the main transistor Q1. A current flows through the primary winding L1 (primary side) of the transformer T1 via the main transistor Q1 to generate high voltage in the secondary winding L2 (secondary side) of the transformer T1, and generate voltage in the tertiary winding L3 (tertiary side) of the transformer T1. Switching between the ON and OFF states of the main transistor Q1 is repeated using the output from the tertiary side as a control output. When the main transistor Q1 is switched, an LC resonant circuit constituted by the capacitor C1 and the coil L1 resonates to repeatedly generate high voltage on the secondary side of the transformer T1. By the high voltage generated on the secondary side of the transformer T1, a spark is generated at a gap between high-voltage terminals TE1 and TE2 to ignite a target object with this spark.

In the conventional solid-state ignitor described above, however, the following problems arise due to decreases in ambient temperature and power supply voltage $V_{DC}$.

[Decrease in Ambient Temperature]

As a general characteristic, a decrease in ambient temperature decreases a current gain ($h_{FE}$) of the main transistor Q1, thereby decreasing a collector current $I_1$ in the main transistor Q1, and also an output current $I_2$ on the secondary side of the transformer T1. For this reason, when the ambient temperature decreases, an output energy is also decreased, and the amount of discharge energy required for igniting a target object is difficult to obtain, thus degrading ignition properties.

When liquid such as oil is used as a target object, the liquid such as oil gels at a low temperature. Oil particles to be sprayed from a nozzle become larger to make ignition more difficult. In particular, when used at an ambient temperature of 0° C. or less, an ignition delay or an ignition miss of the ignitor with respect to a target object frequently occurs.

[Decrease in Power Supply Voltage $V_{DC}$]

A decrease in power supply voltage $V_{DC}$ decreases voltage $V_{CE}$ across the collector and emitter of the main transistor Q1. LC resonant voltage across the capacitor C1, and output voltage on the secondary side of the transformer T1 are also decreased. In addition, the decrease in LC resonant voltage decreases output voltage on the tertiary side of the transformer T1 to decrease a base current $I_B$ for the main transistor Q1. For this reason, the ON time width is narrowed in switching the main transistor Q1, and the collector current $I_1$ in the main transistor Q1 is decreased to decrease the output current $I_2$ on the secondary side of a transformer T2.

More specifically, when the power supply voltage $V_{DC}$ decreases, both the output voltage and current on the secondary side of the transformer T2 are decreased, and an output energy is reduced. A discharge energy required for igniting a target object is difficult to obtain, degrading ignition properties. In particular, when the ignitor is used under the environment where the commercial power supply $V_{AC}$ greatly varies, e.g., in a factory, an ignition delay and an ignition miss frequently occur.

SUMMARY OF THE INVENTION

It is an object of the present invention to provide an ignitor having good ignition properties with respect to a decrease in ambient temperature.

It is another object of the present invention to provide an ignitor having good ignition properties with respect to a decrease in power supply voltage.

In order to achieve the above objects, according to the present invention, there is provided an ignitor comprising a first transistor which is activated in accordance with supply from a DC power supply to perform switching; a transformer having a primary winding through which a switching current flows via the first transistor, a secondary winding for generating high voltage when the switching current flows through the first winding, and a tertiary winding for generating a control output for controlling the switching of the first transistor in accordance with the high voltage generated in the secondary winding; ignition means for igniting a target object using the high voltage generated in the secondary winding of the transformer; and switching control means for prolonging an ON time for the switching of the first transistor in accordance with a decrease in at least one of an ambient temperature and power supply voltage.

BRIEF DESCRIPTION OF THE DRAWINGS

FIGS. 2A to 2D are timing charts for explaining the operations of the solid-state ignitor shown in FIG. 1 when the ambient temperature and the power supply voltage decrease;

DESCRIPTION OF THE PREFERRED EMBODIMENTS

An ignitor of the present invention will be described below with reference to the accompanying drawings.

[Embodiment 1]

Figure 1:
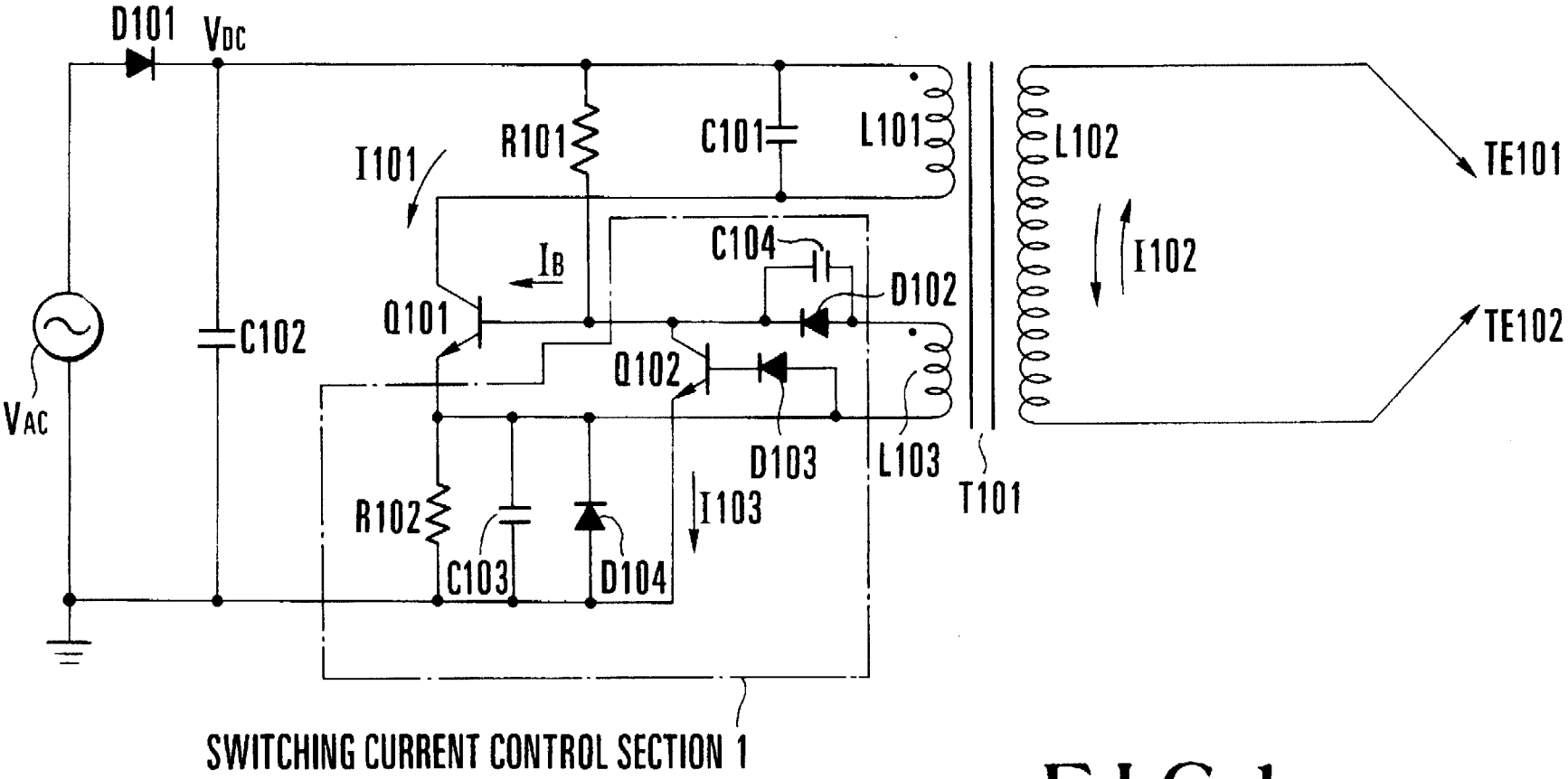
FIG. 1 is a circuit diagram showing a solid-state ignitor according to Embodiment 1 of the present invention.
Figure 8:
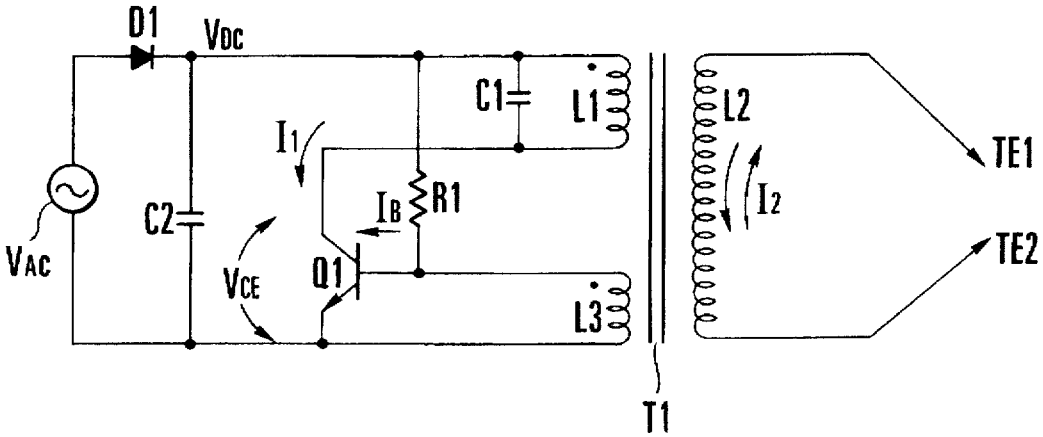
FIG.8 PRIOR ART
FIG. 8 is a circuit diagram showing a conventional solid-state ignitor.

FIG. 1 shows a solid-state ignitor according to an embodiment of the present invention. Referring to FIG. 1, reference symbol $V_{AC}$ denotes a commercial power supply (AC 100 V) one terminal of which is connected to a signal ground; D101, a rectifying diode connected in series with the commercial power supply $V_{AC}$; C102, a smoothing capacitor connected parallel to the circuit obtained by connecting the commercial power supply $V_{AC}$ and the diode D101 in series with each other; Q101, a main transistor; R101, a resistor connected between one terminal of a capacitor C101 and the base of the main transistor Q101 to activate the main transistor Q101; T101, a transformer; L101, a primary winding of the transformer T101 which is connected between one terminal of the capacitor C101 and the collector of the main transistor Q101; L102, a secondary winding of the transformer T101 having both terminals connected to high-voltage terminals TE101 and TE102, respectively; and L103, a tertiary controlling winding of the transformer T101. Reference numeral 1 denotes a switching current control section connected between the main transistor Q101 and the transformer T101. The switching current control section 1 for controlling a switching current in the main transistor Q101 is added to the conventional solid-state ignitor shown in FIG. 8 to obtain the ignitor of Embodiment 1.

The switching current control section 1 is constituted by a sub-transistor Q102, a resistor R102, diodes D102 to D104, and capacitors C103 and C104. In the switching current control section 1, the collector of the sub-transistor Q102 is connected to the base of the main transistor Q101, the base of Q102 is connected to the emitter of the main transistor Q101 via the diode D103, and the emitter is connected to the signal ground. The emitter of the main transistor Q101 is connected to the signal ground via the resistor R102. The capacitor C103 and the diode D104 are connected parallel to the resistor R102. A circuit obtained by connecting the diode D102 and the capacitor C104 parallel to each other is connected between the base of the main transistor Q101 and one terminal of the tertiary winding L103 of the transformer T101. The other terminal of the tertiary winding L103 of the transformer T101 is connected to the emitter of the main transistor Q101.

The diode D102 and the capacitor C104 adjust a base current which flows through the main transistor Q101. The capacitor C104 mainly contributes to good rising of the base current for the main transistor Q101, while the diode D102 supplies the base current for the main transistor Q101 for a predetermined period of time or more. In addition, the capacitor C103 adjusts the ON timing for the sub-transistor Q102, while the diode D104 causes the main transistor Q101 to oscillate stably.

In Embodiment 1, an npn bipolar transistor having a current gain $h_{FE}$ of 10 to 50, and an npn bipolar transistor having a current gain $h_{FE}$ of 200 or more are used as the main transistor Q101 and the sub-transistor Q102, respectively. As general characteristics, a decrease in ambient temperature decreases the current gains $h_{FE}$ of the transistors Q101 and Q102. Further, as general characteristics, voltage drops across the diodes D103 and D104 also become large with a decrease in ambient temperature.

In this circuit, the commercial power supply $V_{AC}$ is rectified and smoothed by the diode D101 and the capacitor C102, and DC power supply voltage $V_{DC}$ is applied to a circuit connected to the output stage. By this power supply voltage $V_{DC}$, a base current flows via the resistor R101 to activate the main transistor Q101. A current flows through the primary winding L101 (primary side) of the transformer T101 via the main transistor Q101 to generate high voltage in the secondary winding L102 (secondary side) of the transformer T101, and generate voltage in the tertiary winding L103 (tertiary side) of the transformer T101. Switching between the ON and OFF states of the main transistor Q101 is repeated using the output from the tertiary side as a control output. When the main transistor Q101 is switched, an LC resonant circuit constituted by the capacitor C101 and the coil L101 resonates to repeatedly generate high voltage on the secondary side of the transformer T101. By the high voltage generated on the secondary side of the transformer T101, a spark is generated at a gap between a pair of high-voltage terminals TE101 and TE102 having a predetermined interval therebetween to ignite a target object with this spark.

FIGS. 2A to 2D explain the operation states of the activated circuit shown in FIG. 1, in which FIG. 2A shows base-emitter voltage $V_{BE}$ in the main transistor Q101, FIG. 2B shows a base current $I_B$ in the main transistor Q101, FIG. 2C shows a collector current $I_{101}$ in the main transistor Q101, and FIG. 2D shows a collector current $I_{103}$ in the sub-transistor Q102. Note that, in each of FIGS. 2A to 2D, a waveform indicated by a solid line exhibits the case of a low ambient temperature or low power supply voltage $V_{DC}$, and a waveform indicated by a dotted line exhibits the case of a normal ambient temperature or normal power supply voltage $V_{DC}$.

In the circuit shown in FIG. 1, when the power supply voltage $V_{DC}$ is applied, the base current $I_B$ flows through the main transistor Q101 via the resistor R101 (FIG. 2B) to turn on the main transistor Q101. Upon the ON operation of the main transistor Q101, the collector current $I_{101}$ flows (FIG. 2C) to generate a potential difference across the resistor R102. When this potential difference increases to a predetermined value or more, the diode D103 is turned on, and a base current flows through the sub-transistor Q102 to turn on the sub-transistor Q102. Upon the ON operation of the sub-transistor Q102, the collector current $I_{103}$ flows (FIG. 2D) to shunt the base current $I_B$ in the main transistor Q101. The base current $I_B$ in the main transistor Q101 changes in accordance with output voltage from the tertiary winding L103 of the transformer T101. When the output voltage from the tertiary winding L103 of the transformer T101 increases (rises), the base-emitter voltage $V_{BE}$ is generated in the main transistor Q101 (time t1 shown in FIG. 2A) to turn on the main transistor Q101. When the output voltage from the tertiary winding L103 of the transformer T101 decreases (drops), the base current $I_B$ is decreased (FIG. 2B), and the base-emitter voltage $V_{BE}$ in the main transistor Q101 is decreased (time t2 shown in FIG. 2A) to turn off the main transistor Q101.

[Decrease in Ambient Temperature]

A decrease in ambient temperature decreases not only the current gain $h_{FE}$ of the main transistor Q101 but also the current gain $h_{FE}$ of the sub-transistor Q102. The collector current $I_{103}$ as a shunted current in the sub-transistor Q102 is decreased (FIG. 2D). In addition, since a voltage drop in the diode D103 becomes large at a low temperature, the collector current $I_{103}$ in the sub-transistor Q102 is further decreased. The base current $I_B$ in the main transistor Q101 is increased (FIG. 2B) to prolong the ON time (period TW shown in FIG. 2A) from $TW_1$ indicated by a dotted line to $TW_2$ indicated by a solid line in switching (ON/OFF driving) the main transistor Q101. For this reason, the collector current $I_{101}$ in the main transistor Q101 is increased (FIG. 2C) to compensate the decrease in output current $I_{102}$ in the secondary winding L102 of the transformer T101 due to the decrease in the main transistor Q101.

Figure 3A:
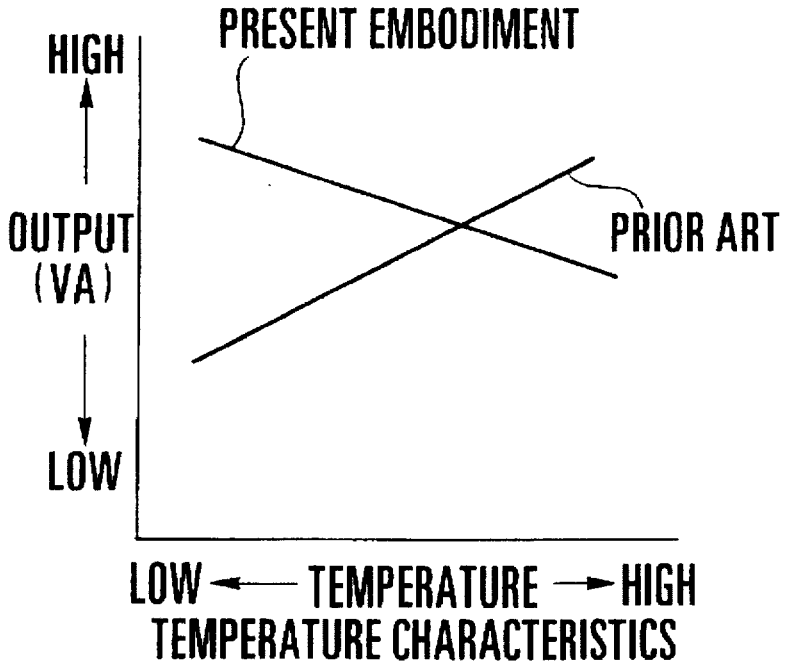
FIGS. 3A and 3B are graphs showing the temperature characteristics and power supply voltage characteristics of the solid-state ignitor shown in FIG. 1, respectively.

In Embodiment 1, the primary winding L101 of the transformer T101 and the capacitor C101 resonate to transfer energy to the secondary side. When the ON width of the main transistor Q101 is widened due to a decrease in ambient temperature, resonant and output voltages slightly increase because oscillation can be performed around a resonant frequency. Therefore, a decrease in output current $I_{102}$ with a decrease in ambient temperature is excessively compensated. When the ambient temperature decreases, the output current $I_{102}$ equal to or more than an output current at a normal ambient temperature can be obtained. That is, as represented by ambient temperature-output energy characteristics (temperature characteristics) in comparison with the prior art in FIG. 3A, as the ambient temperature becomes lower, the output energy becomes larger, preventing degradation in ignition properties due to a decrease in ambient temperature.

[Decrease in Power Supply Voltage $V_{DC}$]

As has been explained in the prior art, a decrease in power supply voltage $V_{DC}$ decreases output voltage from the tertiary winding L103 of the transformer T101. The base current $I_B$ to the main transistor Q101 is decreased to decrease the collector current $I_{101}$ in the main transistor Q101. When the collector current $I_{101}$ in the main transistor Q101 is decreased, a voltage drop in the resistor R102 becomes small, the base-emitter voltage $V_{BE}$ in the sub-transistor Q102 is decreased, and the collector current $I_{103}$ as a shunted current in the sub-transistor Q102 is decreased (FIG. 2D). The base current $I_B$ in the main transistor Q101 is increased (FIG. 2B) to prolong the ON time (period TW shown in FIG. 2A) from $TW_1$ indicated by the dotted line to $TW_2$ indicated by the solid line in switching (ON/OFF driving) the main transistor Q101. For this reason, the collector current $I_{101}$ in the main transistor Q101 is increased (FIG. 2C) to compensate the decrease in output current $I_{102}$ in the secondary winding L102 due to the decrease in output voltage from the tertiary winding L103 of the main transistor Q101. Further, in Embodiment 1, the primary winding L101 of the transformer T101 and the capacitor C101 resonate to transfer energy to the secondary side. When the ON width of the main transistor Q101 is widened (power supply voltage is decreased), resonant and output voltages slightly increase because oscillation can be performed around a resonant frequency. When the ON width of the main transistor Q101 is narrowed (power supply voltage is increased), the resonant and output voltages slightly decrease because oscillation is performed at a frequency slightly shifted from the resonant frequency. That is, the circuit operates so as to keep the peak value of output voltage constant.

Figure 3B:
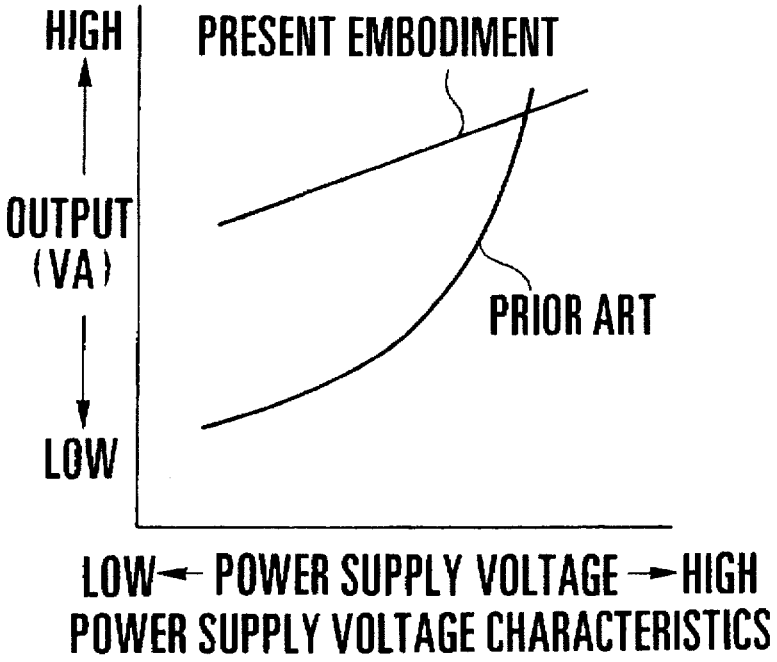

FIG. 3B shows power supply voltage-output energy characteristics (power supply voltage characteristics) in this case in comparison with the prior art. In this manner, according to Embodiment 1, the degree of a decrease in output energy is small with respect to a decrease in power supply voltage $V_{DC}$, thereby preventing degradation in ignition properties due to the decrease in power supply voltage $V_{DC}$.

[Embodiment 2]

Figure 4:
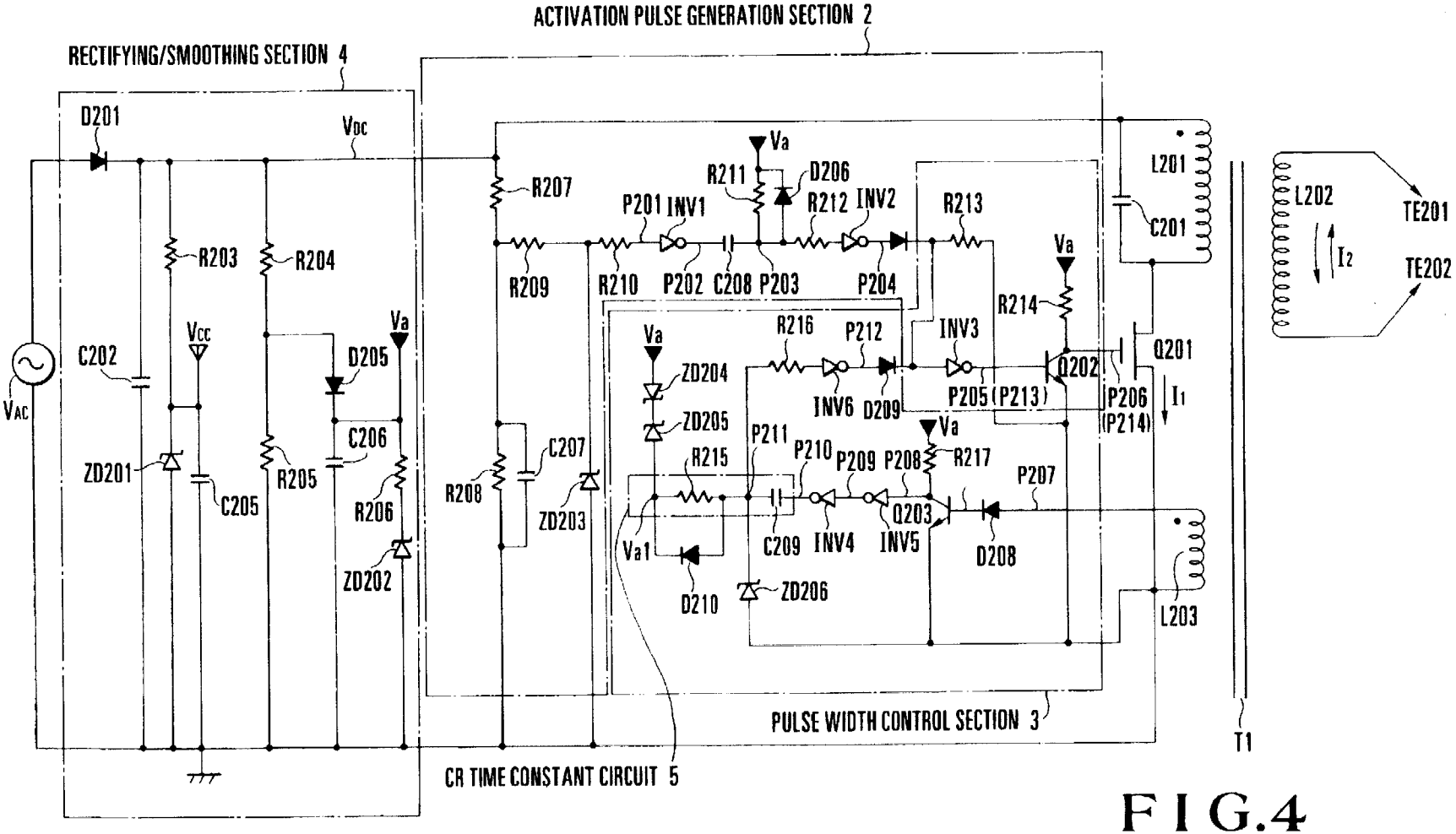
FIG. 4 is a circuit diagram showing a solid-state ignitor according to Embodiment 2 of the present invention.

FIG. 4 shows a solid-state ignitor according to another embodiment of the present invention. In Embodiment 2, a field effect transistor (FET) is used as a main transistor Q201. An activation pulse generation section 2 for generating an activation pulse, and a pulse width control section 3 for controlling the pulse width of switching voltage are arranged. Resistors R203 to R206, capacitors C205 and C206, a diode D205, and Zener diodes ZD201 and ZD202 are arranged in addition to a diode D201 and a capacitor C202 in a rectifying/smoothing section 4.

The activation pulse generation section 2 is constituted by a transistor Q202, resistors R207 to R214, capacitors C207 and C208, diodes D206 and D207, inverters INV201 to INV203, and a Zener diode ZD203. The pulse width control section 3 is constituted by the transistor Q202, a transistor Q203, resistors R213 to R217, a capacitor C209, diodes D208 to D210, inverters INV203 to INV206, and Zener diodes ZD204 to ZD206. Note that the transistor Q202, the resistors R213 and R214, and the inverter INV203 are commonly used for the activation pulse generation section 2 and the pulse width control section 3.

In the pulse width control section 3, a CR time constant circuit 5 is constituted by the capacitor C209 and the resistor R215. Voltage $V_{a1}$ which changes in accordance with power supply voltage $V_{DC}$ via the Zener diodes ZD204 and ZD205 is applied to one terminal of the CR time constant circuit 5 on the resistor R215 side. Voltage which changes between "L" and "H" levels in accordance with voltage on the tertiary side of a transformer T201 via the inverter INV204 is applied to the other terminal of the CR time constant circuit 5 on the capacitor C209 side.

In Embodiment 2, a capacitor such as a ceramic capacitor which increases in capacitance with a decrease in temperature is used as the capacitor C209. As the Zener diode ZD205, a diode having Zener voltage of 5.1 V or less is used in which a decrease in temperature increases the Zener voltage. As the Zener diode ZD204, a diode is used in which a decrease in temperature increases forward voltage.

Figures 5A, 5B, 5C, 5D, 5E, 5F, 5G:
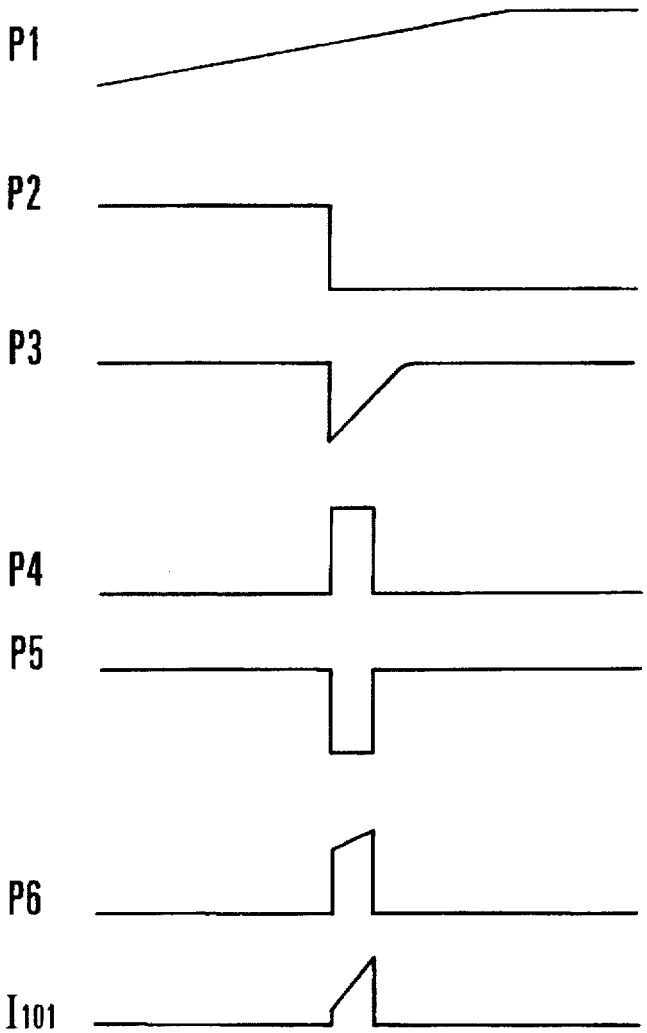
FIGS. 5A to 5G are timing charts showing the operations of an activation pulse generation section in the solid-state ignitor shown in FIG. 4.

In the circuit shown in FIG. 4, a commercial power supply $V_{AC}$ is rectified and smoothed by the diode D201 and the capacitor C202, and is applied as DC power supply voltage $V_{DC}$ to a circuit connected to the output stage. Upon reception of the power supply voltage $V_{DC}$, waveforms change at points P1 to P6 in the activation pulse generation section 2, as shown in FIGS. 5A to 5F. A one-shot pulse shown in FIG. 5F is supplied to the gate of the FET Q201. By the one-shot pulse, the FET Q201 is activated to cause a current $I_{201}$ to flow (FIG. 5G). A current flows through a primary winding L201 (primary side) of the transformer T201 via the FET Q201 to generate high voltage in the secondary winding L202 (secondary side) of the transformer T201.

On the other hand, voltage is also generated in a tertiary winding L203 (tertiary side) of the transformer T201. The FET Q201 is continuously switched using an output from the tertiary side as a control output via the pulse width control section 3. A capacitor C201 and the coil L201 LC-resonate to repeatedly generate high voltage on the secondary side of the transformer T201. By this high voltage, a spark is generated between high-voltage terminals TE201 and TE202 to ignite a target object with this spark.

Figures 6A, 6B, 6C, 6D, 6E, 6F, 6G, 6H, 6I:
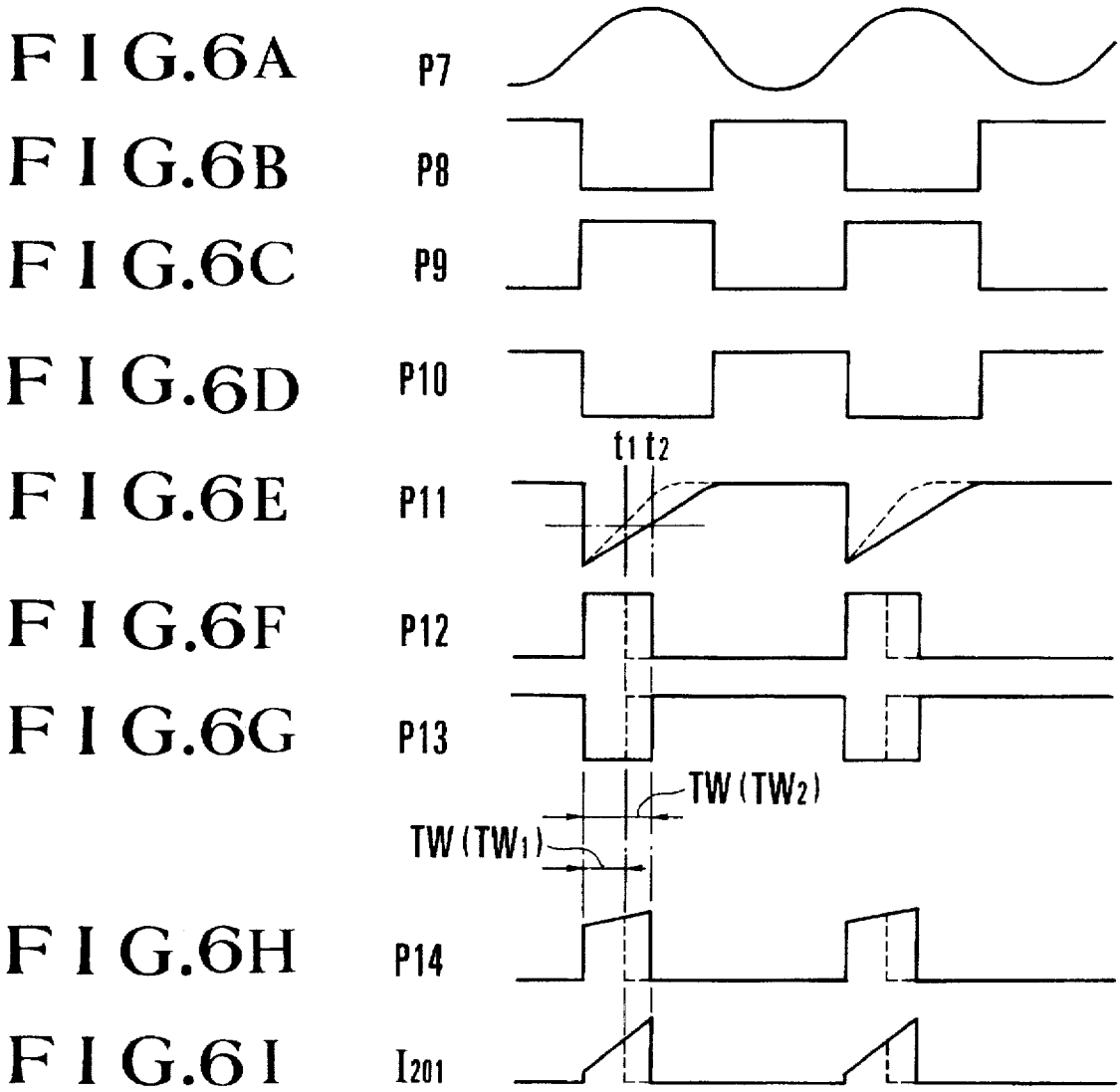
FIGS. 6A to 6I are timing charts for explaining the operations of the solid-state ignitor shown in FIG. 4 when the ambient temperature and the power supply voltage decrease.

FIGS. 6A to 6H show waveforms at points P7 to p14 in the pulse width control section 3, respectively, and FIG. 6I shows the current $I_{201}$ flowing through the FET Q201. Note that, in each of FIGS. 6E to 6I, a waveform indicated by a solid line exhibits the case of a low ambient temperature or low power supply voltage $V_{DC}$, and a waveform indicated by a dotted line exhibits the case of a normal ambient temperature or normal power supply voltage $V_{DC}$.

In the pulse width control section 3, an output from the tertiary side of the transformer T201 appears as a control output at the point P7 (FIG. 6A). By the control output, the transistor Q203 is switched to generate voltage at the point P8 at "L"/"H" level in accordance with the ON/OFF state of the transistor Q203 (FIG. 6B). The voltage at the point P8 is applied to the inverter INV205 and inverted (FIG. 6C), and further inverted by the inverter INV204 (FIG. 6D). The resultant voltage is applied to the other terminal of the CR time constant circuit 5 on the capacitor C209 side.

On the other hand, the voltage $V_{a1}$ which changes in accordance with the power supply voltage $V_{DC}$ via the Zener diodes ZD204 and ZD205 is applied to one terminal of the CR time constant circuit 5 on the resistor R215 side. When the other terminal side of the CR time constant circuit 5 goes to "L" level, a charging current flows from one terminal side of the CR time constant circuit 5 to the capacitor C209 to increase voltage across the capacitor C209 (FIG. 6E).

When the voltage across the capacitor C209 reaches a predetermined value after a lapse of time based on the time constant of the CR time constant circuit 5, i.e., a potential at the point P11 reaches a predetermined value (time t1 shown in FIG. 6E), an output from the inverter INV206 is inverted to "L" level (time t1 shown in FIG. 6F). An output from the inverter INV203 is also inverted to "H" level (time t1 shown in FIG. 6G). The transistor Q202 is turned on by an output of "H" level from the inverter INV203, and gate voltage to the FET Q201 drops to "L" level (time t1 shown in FIG. 6H). The FET Q201 is turned off to interrupt the current $I_{201}$ flowing through the FET Q201 (time t1 shown in FIG. 6I).

[Decrease in Ambient Temperature]

When the ambient temperature decreases, the capacitance of the capacitor C209 in the CR time constant circuit 5 is increased to increase the time constant of the CR time constant circuit 5. In addition, the Zener voltage of the Zener diode ZD205 and the forward voltage of the Zener diode ZD204 are increased to decrease the voltage $V_{a1}$ to be applied to one terminal of the CR time constant circuit 5. Since the rate of increase of charging voltage for the capacitor C209 becomes low, a time required for increasing voltage across the capacitor C209 to a predetermined value is prolonged to interrupt the current $I_{201}$ flowing through the FET Q201 at time t2 after time t1 shown in FIG. 6E.

When the ambient temperature decreases, the switching pulse width (period TW shown in FIG. 6H) in switching the FET Q201 is widened from $TW_1$ indicated by a dotted line to $TW_2$ indicated by a solid line. That is, since the ON time in ON/OFF-driving the FET Q201 is prolonged from $TW_1$ to $TW_2$ to increase a drain current flowing through the FET Q201, a decrease in drain current due to an increase in threshold voltage across the gate and source of the FET Q201, and the like can be suppressed to compensate a decrease in output current $I_{202}$.

Figure 7A:
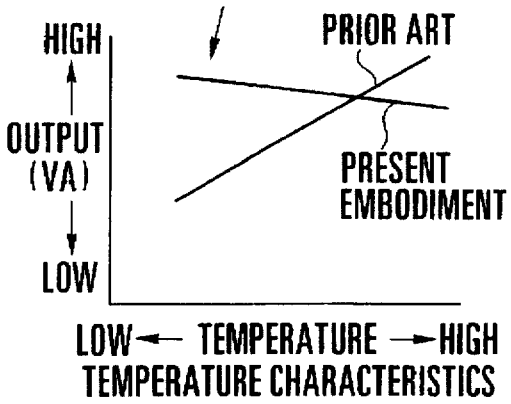
FIGS. 7A and 7B are graphs showing the temperature characteristics and power supply voltage characteristics of the solid-state ignitor shown in FIG. 4, respectively.

In Embodiment 2, a decrease in output current $I_{202}$ with a decrease in ambient temperature is excessively compensated. When the ambient temperature decreases, the output current $I_{202}$ equal to or more than an output current at a high ambient temperature can be obtained. That is, as represented by ambient temperature-output energy characteristics (temperature characteristics) in comparison with the prior art in FIG. 7A, as the ambient temperature becomes lower, the output energy becomes larger, preventing degradation in ignition properties due to a decrease in ambient temperature.

[Decrease in Power Supply Voltage $V_{DC}$]

When the power supply voltage $V_{DC}$ decreases, voltage $V_a$ to be applied to the anode of the Zener diode ZD204 is decreased to decrease the voltage $V_{a1}$ to be applied to one terminal of the CR time constant circuit 5. Since the rate of increase of charging voltage for the capacitor C209 becomes low, a time required for increasing voltage across both the terminals of the capacitor C209 to a predetermined value is prolonged to interrupt the current $I_{201}$ flowing through the FET Q201 at time t2 after time t1 shown in FIG. 6E.

When the power supply voltage $V_{DC}$ decreases, the switching pulse width (period TW shown in FIG. 6H) in switching the FET Q201 is widened from $TW_1$ indicated by the dotted line to $TW_2$ indicated by the solid line. That is, since the ON time in ON/OFF-driving the FET Q201 is prolonged from $TW_1$ to $TW_2$, a current flowing through the FET Q201 is increased to compensate a decrease in output current $I_{202}$ due to a decrease in output voltage from the tertiary side of the transformer T201.

Figure 7B:
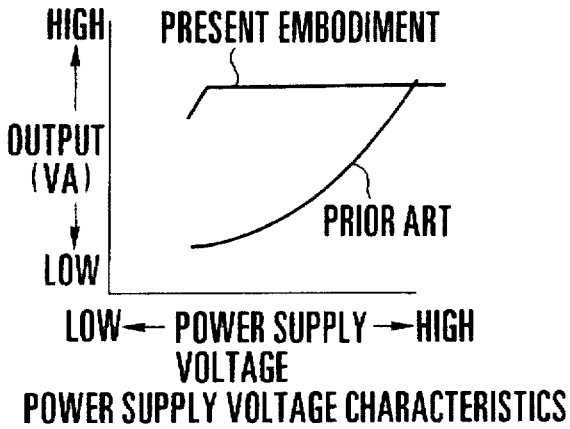

FIG. 7B shows power supply voltage-output energy characteristics in this case in comparison with the prior art. In this manner, according to Embodiment 2, the decrease amount of output voltage with a decrease in power supply voltage $V_{DC}$ is also compensated by the increase amount of the output current $I_{202}$. An output energy is kept constant with respect to the decrease in power supply voltage $V_{DC}$, thereby preventing degradation in ignition properties due to the decrease in power supply voltage $V_{DC}$.

As has been apparent from the above description, according to the present invention, when the ambient temperature or the power supply voltage decreases, the ON time in switching a main transistor is prolonged to increase a current flowing through the primary side of a transformer via the main transistor. Therefore, a decrease in output energy on the secondary side of the transformer is compensated. Good ignition properties can be obtained with respect to decreases in ambient temperature and power supply voltage.

What is claimed is:

1. An ignitor comprising:

a first transistor which is activated in accordance with supply from a DC power supply to perform switching;

a transformer having a primary winding through which a switching current flows via said first transistor, a secondary winding for generating high voltage when the switching current flows through said first winding, and a tertiary winding for generating a control output for controlling the switching of said first transistor in accordance with the high voltage generated in said secondary winding;

ignition means for igniting a target object using the high voltage generated in said secondary winding of said transformer; and switching control means for prolonging an ON time for the switching of said first transistor to compensate for a decrease in igniting energy due to a decrease in at least one of an ambient temperature and power supply voltage using said control output from said tertiary winding.

2. An ignitor according to claim 1, wherein said tertiary winding of said transformer is connected between a base and emitter of said first transistor, and said switching control means is constituted by:

a second transistor having a collector connected to said base of said first transistor, and an emitter connected to one terminal of said DC power supply;

a resistor connected between said emitter of said first transistor and one terminal of said DC power supply; and a diode connected in a forward direction between said emitter of said first transistor and a base of said second transistor.

3. An ignitor according to claim 1, wherein said switching control means is constituted by:

time constant circuit means having a capacitor which increases in capacitance with a decrease in temperature, said capacitor being charged by voltage which decreases in accordance with a decrease in power supply voltage when output voltage is generated in said tertiary winding of said transformer; and driving means for turning on said first transistor until charging voltage for said capacitor reaches a predetermined value.

4. An ignitor according to claim 3, wherein said time constant circuit means has one terminal to which voltage which changes in accordance with a variation in power supply voltage is applied, and the other terminal to which voltage which changes in accordance with an output from said tertiary winding of said transformer is applied.

5. An ignitor according to claim 3, further comprising activation pulse generation means for supplying an activation pulse to said first transistor at a start of application of power supply voltage, and wherein said first transistor is constituted by a field effect transistor which is activated by the activation pulse from said activation pulse generation means.

* * * * *

UNITED STATES PATENT AND TRADEMARK OFFICE

CERTIFICATE OF CORRECTION

PATENT NO. : 5,720,607
DATED : February 24, 1998
INVENTOR(S) : Morio et al.

It is certified that error appears in the above-identified patent and that said Letters Patent is hereby corrected as shown below:

Title page,
Item [21], Application Number, replace number "589,744" with -- 08/589,744 --.

Signed and Sealed this

Fourth Day of December, 2001

*Attest:*

Nicholas P. Godici

NICHOLAS P. GODICI
*Acting Director of the United States Patent and Trademark Office*

*Attesting Officer*